US011040568B1

(12) United States Patent
Hanson et al.

(10) Patent No.: US 11,040,568 B1
(45) Date of Patent: Jun. 22, 2021

(54) CONVERTIBLE APPARATUS FOR SHARPENING MARKING INSTRUMENTS

(71) Applicant: CH HANSON CO, Naperville, IL (US)

(72) Inventors: Phil Hanson, Granbury, TX (US); Paul Hu, North York (CA)

( * ) Notice: Subject to any disclaimer, the term of this patent is extended or adjusted under 35 U.S.C. 154(b) by 0 days.

(21) Appl. No.: 16/911,509

(22) Filed: Jun. 25, 2020

(51) Int. Cl.
*B43L 23/08* (2006.01)

(52) U.S. Cl.
CPC ..... *B43L 23/08* (2013.01)

(58) Field of Classification Search
CPC ..... B43L 23/08; B43L 23/00; B43L 23/004; B43L 23/008
USPC ..... 30/451
See application file for complete search history.

(56) References Cited

U.S. PATENT DOCUMENTS

| | | | | |
|---|---|---|---|---|
| 2,757,638 | A | 8/1956 | Goldstein | |
| 4,081,010 | A | 3/1978 | Galli | |
| 4,281,698 | A * | 8/1981 | Mobius | B43L 23/08 30/454 |
| 5,984,669 | A | 4/1999 | Luttgens | |
| D420,390 | S | 2/2000 | Donaldson | |
| 6,092,293 | A | 8/2000 | Donaldson | |
| 6,301,791 | B1 | 10/2001 | Luttgens | |
| 6,338,198 | B1 | 1/2002 | Rolls | |
| 6,494,638 | B1 | 12/2002 | Donaldson | |
| 6,571,480 | B1 | 6/2003 | Qui | |
| D477,847 | S | 7/2003 | Gosse | |
| 6,698,100 | B2 | 3/2004 | Yan | |
| D502,965 | S | 3/2005 | Donaldson et al. | |
| 6,948,251 | B2 | 9/2005 | Jebe et al. | |
| 7,225,547 | B2 | 6/2007 | Luttgens | |
| 7,523,557 | B2 | 4/2009 | Smith et al. | |
| 8,656,600 | B2 | 2/2014 | Hammer | |
| 8,708,619 | B2 * | 4/2014 | Rozycki | B23B 45/00 408/26 |
| 8,726,527 | B2 | 5/2014 | Constantine et al. | |
| 2005/0005459 | A1 | 1/2005 | Donaldson | |
| 2005/0091857 | A1 | 5/2005 | Smith et al. | |
| 2006/0185178 | A1 | 8/2006 | Smith et al. | |
| 2007/0180713 | A1 | 8/2007 | Donaldson | |
| 2009/0071018 | A1 | 3/2009 | Smith et al. | |
| 2015/0224816 | A1 * | 8/2015 | Weiland | B43L 23/04 30/453 |

FOREIGN PATENT DOCUMENTS

| | | | | |
|---|---|---|---|---|
| FR | 2720034 B3 * | 4/1996 | | B43L 23/08 |

* cited by examiner

*Primary Examiner* — Omar Flores Sanchez
(74) *Attorney, Agent, or Firm* — David A. Gottardo, Attorney at Law

(57) ABSTRACT

This invention relates generally to an apparatus for sharpening marking instruments. More specifically, the invention relates to a sharpener that is convertible for effectively and efficiently sharpening both carpenter's pencils and crayons. The sharpener has a removable and rotatable cap that facilitates the axial alignment of the carpenters' pencil within the sharpener. The sharpener further comprises primary and secondary alignment surfaces for axially aligning the carpenter's crayon within the sharpener, having the cap removed.

7 Claims, 6 Drawing Sheets

CONVERTIBLE APPARATUS FOR SHARPENING MARKING INSTRUMENTS

CROSS REFERENCE TO RELATED APPLICATIONS

None.

TECHNICAL FIELD OF THE INVENTION

This invention relates generally to an apparatus for sharpening marking instruments. More specifically, the invention relates to a sharpener that is convertible for effectively and efficiently sharpening both carpenter's pencils and crayons.

BACKGROUND OF THE INVENTION

Carpenter's pencils and crayons have long been used in the trades to mark or write on lumber and other construction materials. A standard carpenter's pencil typically defines a flattened hexagonal cross section while a standard carpenter's crayon typically defines a non-flattened hexagonal cross section. In other embodiments, carpenter's pencils and crayons define round cross sections as well. The flattened hexagonal cross section of the pencil defines a width of about 15 millimeters and a height of about 8 millimeters while the non-flattened cross section of the crayon defines a width of about 15 millimeters and a height of about 13 millimeters. The need to readily sharpen these implements in the field is also well known, with carpenters and other trades personnel typically sharpening such pencils and crayons with a standard utility knife.

Due to the cumbersome nature of sharpening carpenter's pencils and crayons with a utility knife, dedicated sharpening devices have been devised. Because of the differences in shape existing between carpenter's pencils and crayons, such sharpening devices have comprised a base sharpener utilizing a rotatable portion for axially stabilizing the flattened hexagonal pencil in relation to the base, with the rotatable portion being removable from the base sharpener to accommodate the sharpening of non-flattened hexagonal crayons therein. Axial stabilization of the pencil is important in preventing a breaking off of the pencil's lead tip during sharpening operations, with such breakage typically occurring when one holding and rotating the pencil inadvertently moves the non-sharpening end of the pencil out of axial alignment with the sharpener (i.e., torques the non-sharpening end of the pencil).

Examples of known sharpening devices include those disclosed in U.S. Pat. No. 6,571,480 to Qui and (the Qui sharpener) U.S. Pub. Nos. 2007/0180713 and 2005/0005459 to Donaldson (the Donaldson sharpeners). The Qui sharpener utilizes a rotating collar (pencil centering insert) that is removable from a housing of the sharpener and a separate component, namely, a "clip," to rotatably secure the collar to the housing. Requiring a separate clip, however, presents numerous disadvantages, to include increased manufacturing costs resulting from the need for additional materials and the creation of one or more plastic injection molds. Furthermore, the clip, typically used with the sharpener within the hectic environment of a construction site, is easily misplaced or lost. The Qui sharpener suffers a further disadvantage in addition to requiring a costly and losable clip. Because the collar fits within the a circular cavity of the housing, the cavity, once the collar is removed from the housing, may receive sharpening debris that create interfering contact with the collar when the collar is again inserted into the cavity of the housing.

The Donaldson sharpeners also utilize a rotating collar (centering mechanism) that is removable from the housing (base), with the collar of each sharpener rotatably secured to the respective base via an "encircling shoulder" fit within a "resilient track" encircling the base. However, the Donaldson sharpeners also present numerous disadvantages. For example, like the Qui sharpener, because the collars fit within the base, the shoulder of the collar, once the collar is removed from the base, is subjected to interfering contact, when the collar is again inserted into the base, with any sharpening debris located within the base that fall into the track.

The Qui and Donaldson suffer other significant disadvantages as well. While these sharpeners provide axial stability to a carpenter's pencil, they provide insufficient or inefficient axial stability to carpenter's crayons. Similar to pencils, axial stability is desirable to prevent a torquing movement of the crayon in relation to the sharpener and the resultant breaking off of the tip within the sharpener. With regard to the Donaldson sharpeners, the insufficiency is evident where the respective bases of the Donaldson sharpeners fail to provide one or more alignment surfaces for axially aligning the crayon and where the track of the base defines a diameter greatly exceeding that defined by opening of the "circular cone" defined by the base. With regard to the Qui sharpener, the inefficiency is evident where the Qui sharpener provides an elongated open inlet in addition to a cavity having the inability to axially align a crayon (i.e., where the cavity defines a diameter substantially exceeding that defined by open inlet of the conical cavity). These components together result in added "per sharpener" material costs in a market driven by low price points.

Thus there is a need for a sharpener having a removable rotating portion that is not subjected to interference from sharpening debris when the removable portion is fitted to the base sharpener. The base portion of the sharpener, having the rotating portion removed there-from, should provide both sufficient and efficient axial stability to a carpenter's crayon inserted therein. The present invention satisfies the foregoing needs and desires and presents other advantages as well.

SUMMARY OF THE INVENTION

This invention relates generally to an apparatus for sharpening marking instruments. More specifically, the invention relates to a sharpener that is convertible for effectively and efficiently sharpening both carpenter's pencils and crayons. In one embodiment, the sharpener, comprises a body defining first and second ends, an interior conical wall unitary with the body and defining a through longitudinal slot, with the conical wall further defining a conical interior void coaxially terminating in a through primary orifice defined in the first end of the body. A blade is connected to the body proximal to the slot and defines a longitudinal cutting edge within the conical interior void. A primary circumferal aligning surface is both adjacent to and coaxial with the primary orifice for axially aligning a carpenter's crayon.

A collar is unitary with the body and both adjacent to and coaxial with the primary circumferal aligning surface. The collar comprises a plurality of inwardly deflectable flanges having inner and outer circumferal surfaces. The outer surfaces of the plurality of the flanges respectively define a plurality of outwardly directed circumferal ridges while the inner surfaces of the plurality of flanges define a secondary circumferal aligning surface for further axially aligning the carpenter's crayon.

A cap defines an outwardly directed circumferal groove and a through secondary orifice. The secondary orifice is configured for mating engagement with at least a carpenter's pencil and is coaxial with the circumferal groove. The cap and body are removably attachable to one another via a mating engagement between of the circumferal groove and the ridges, with the mating engagement between the groove and ridges defining both a rotatable relation between the body and cap and a coaxial relation between the primary and secondary orifices. The through secondary orifice axially aligns at least the carpenters' pencil.

DESCRIPTION OF THE EMBODIMENTS

Figure 1:
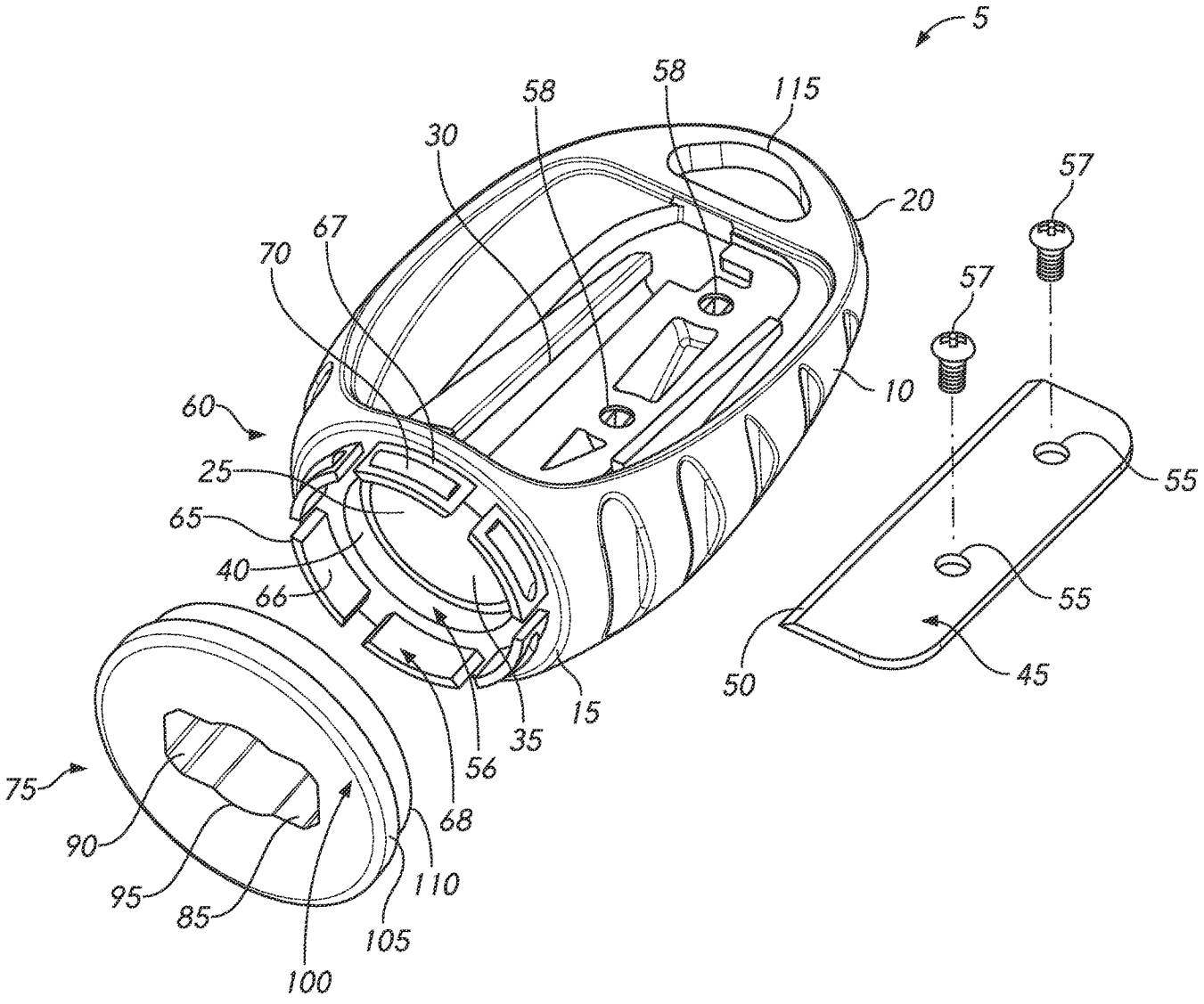
FIG. 1 is a perspective assembly view of one embodiment of the sharpener.
Figure 2:
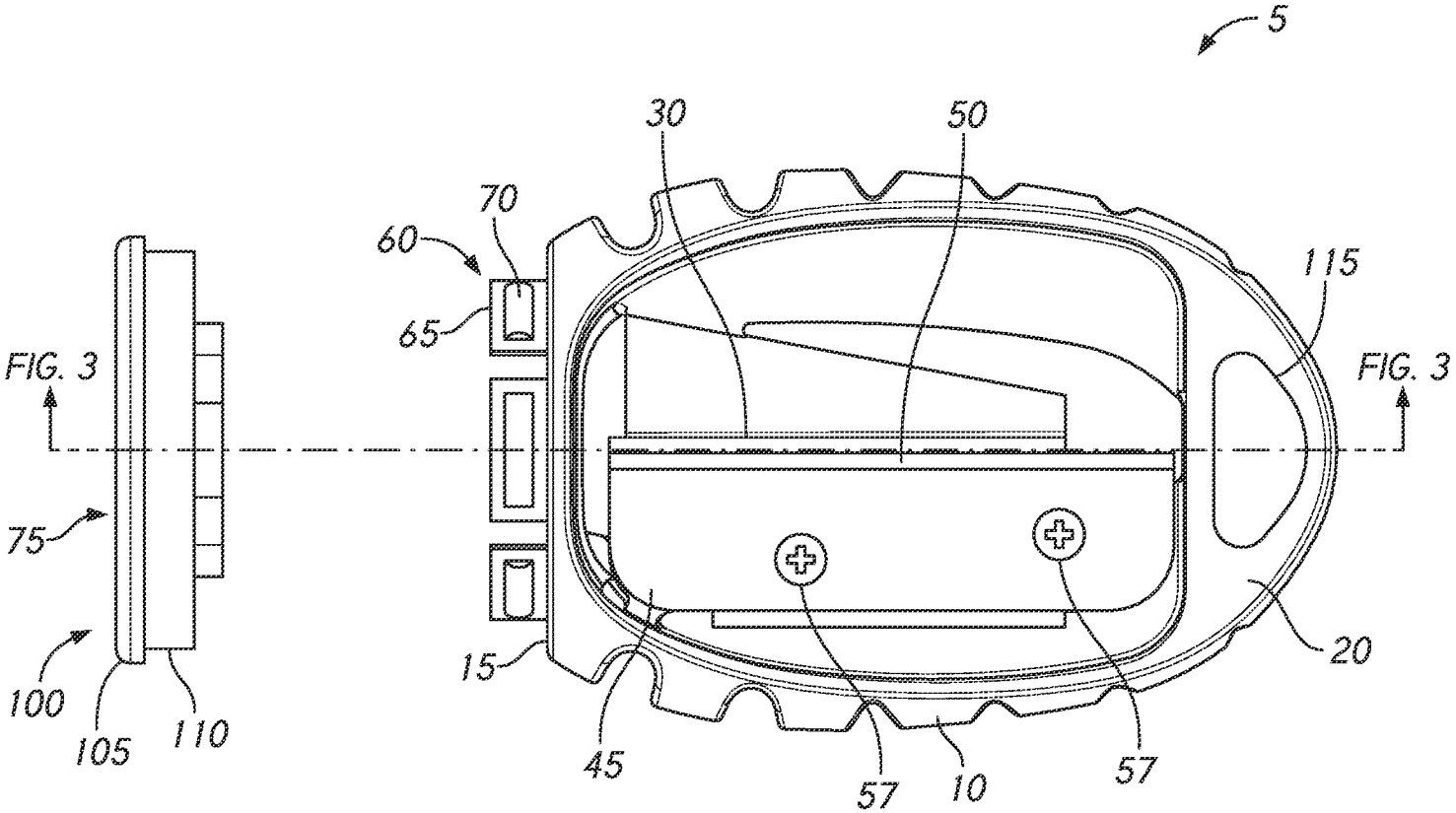
FIG. 2 is a top plan assembly view of the sharpener of FIG. 1 having the blade attached.
Figure 3:
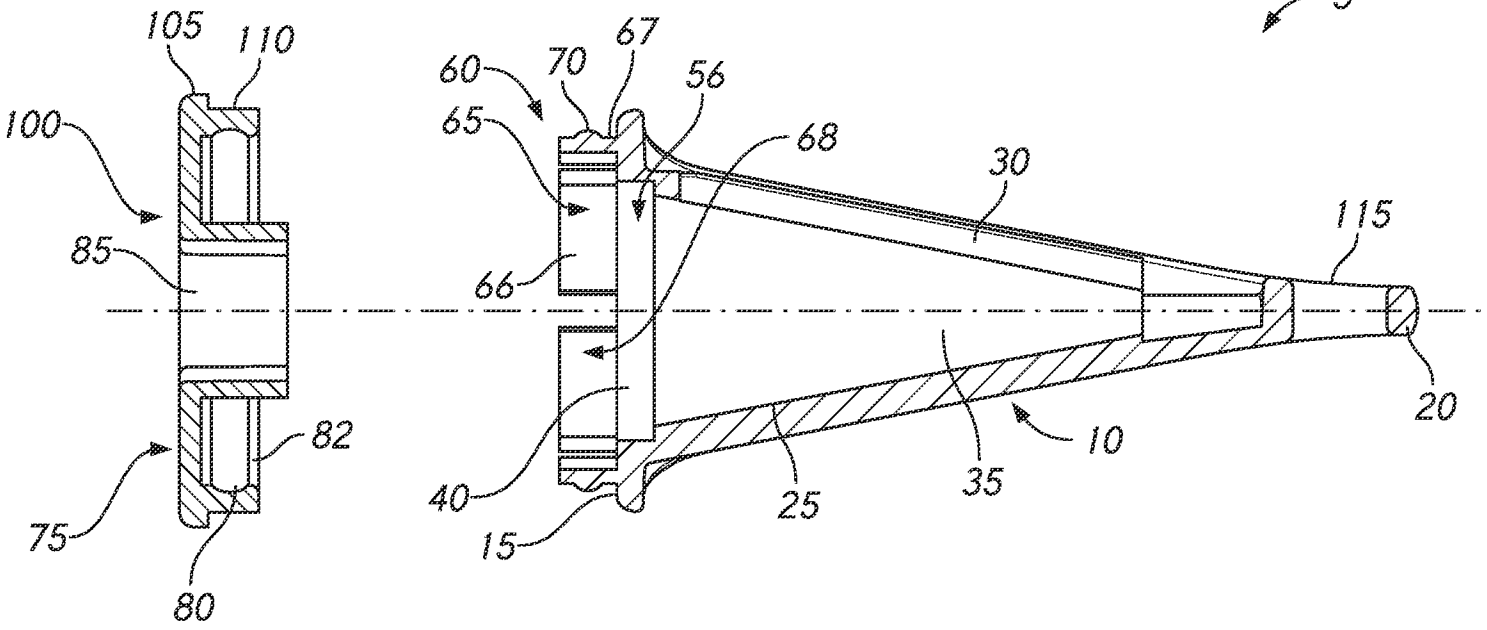
FIG. 3 is a sectional view of the sharpener of FIG. 2.
Figure 4:
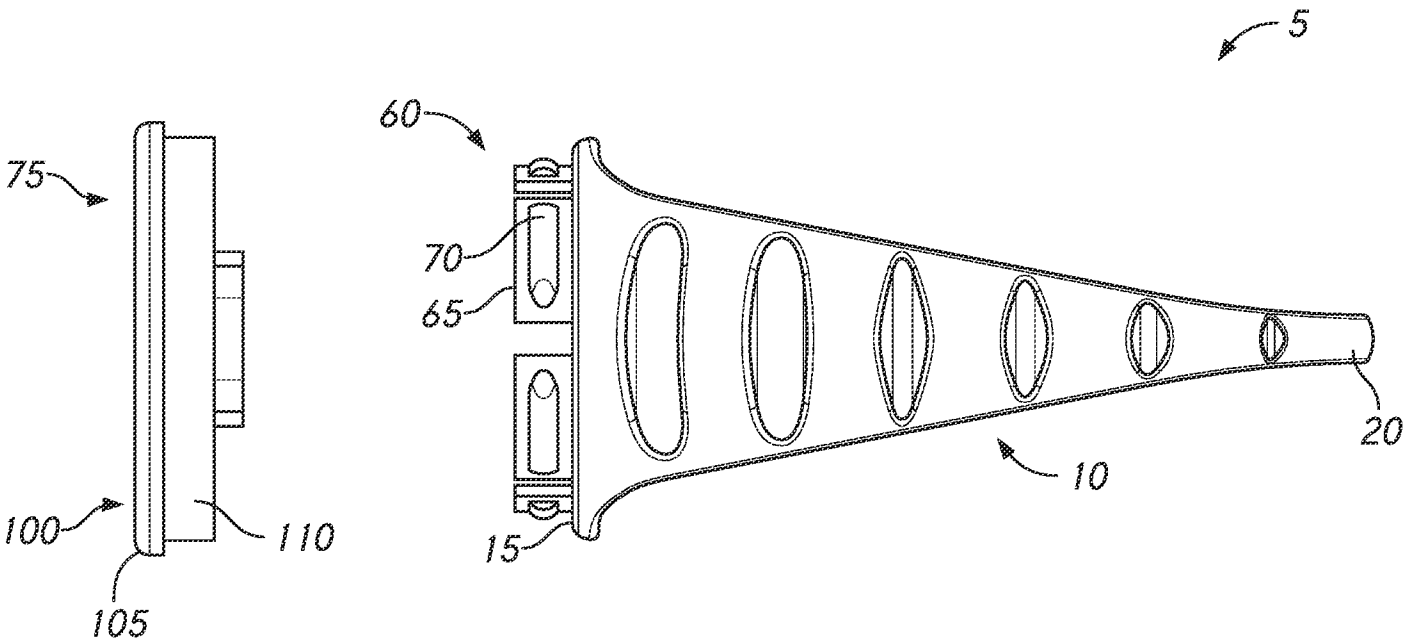
FIG. 4 is an elevation assembly view of the sharpener of FIG. 1.
Figure 5:
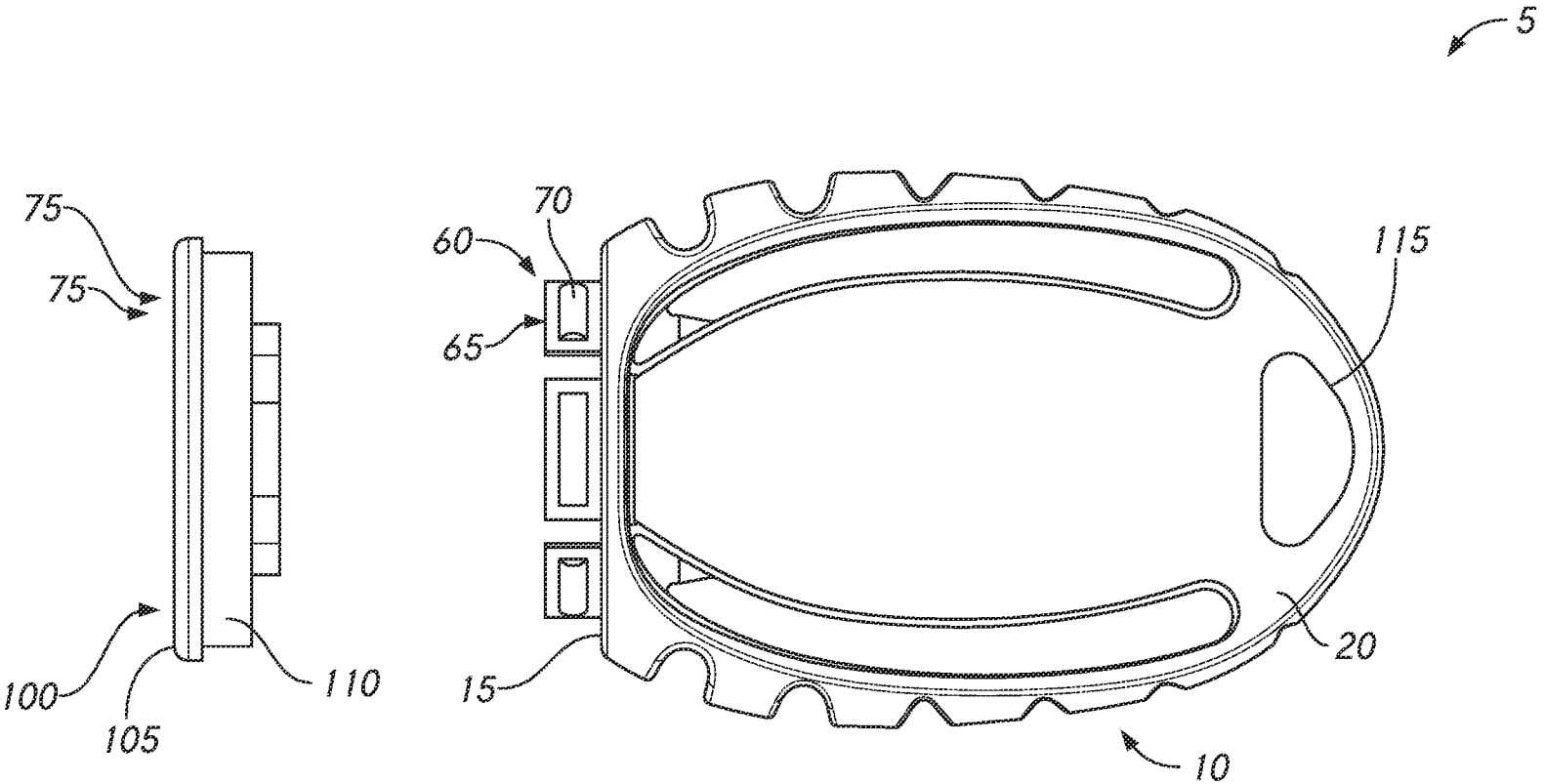
FIG. 5 is a bottom plan assembly view of the sharpener of FIG. 1.
Figure 6:
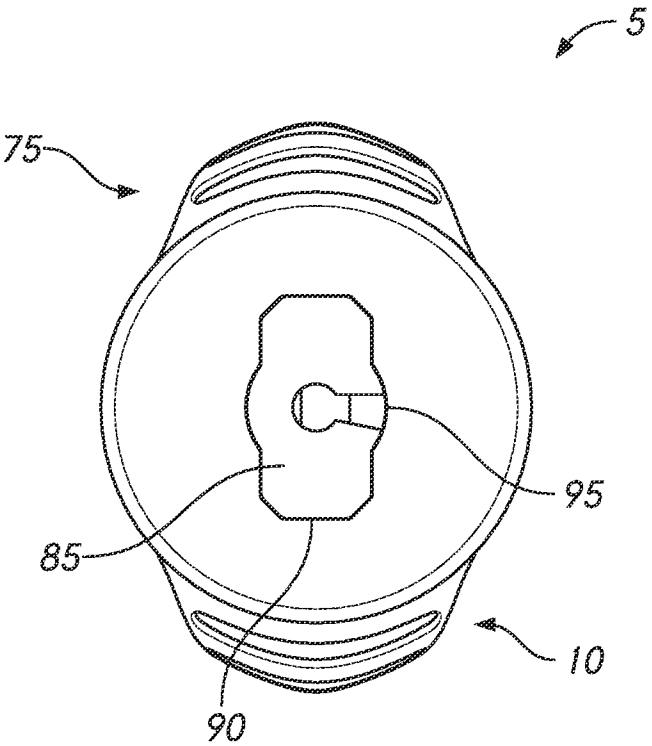
FIG. 6 is an end view of the sharpener of FIG. 1

This invention relates generally to an apparatus for sharpening marking instruments. More specifically, the invention relates to a sharpener that is convertible for effectively and efficiently sharpening both carpenter's pencils and crayons. Referring initially to FIGS. 1-3, the sharpener 5 includes a body 10 defining first and second ends 15 and 20. An interior conical wall 25 is unitary with the body 10 and defines a through longitudinal slot 30. The conical wall 25 further defines a conical interior void 35 coaxially terminating in a through primary orifice 40 defined in the first end 15 of the body 10. The primary orifice 40 and conical void 35 are configured to accept the insertion of an end of either a carpenter's pencil or crayon therein.

A metal blade 45 is connected to the body 10, proximal to the slot 30 and about parallel with the conical wall 25. The blade 45 defines a straight longitudinal cutting edge 50, extending through the longitudinal slot 30 and to within the conical interior void 35 for cutting and shaping the inserted end of the pencil or crayon. Shavings and other materials cut from the pencil or crayon by the blade 45 exit the conical void 35 and housing through the longitudinal slot 30. The blade 45 preferably comprises stainless steel. However, it is understood that the blade 45 may comprise ferrous steel, aluminum, various metallic alloys or any other metal understood in the art as well. In a preferred embodiment, the blade 45 defines a plurality of through bores 55 for attaching the blade to the sharpener's body 10 via a plurality of screws driven through the bores 58 defined by the body. However, it is understood that the blade may be attached to the body via heat welding, adhesives, force fit or any other fastening method understood in the art. Also in a preferred embodiment, the wall-to-wall angle of the conical wall 25 defining the conical void 35 is about 21.2 degrees (i.e., about 10.6 degrees between the conical wall and axis). Because the blade 45 is about parallel the conical wall 25, the blade's cutting edge 50 will shape and cut the inserted end of a pencil or crayon to have a tip bearing about the same 21.2 degree angle.

Referring again to FIGS. 1 and 3, the primary orifice 40 defined by the conical wall 25 preferably defines a circular bore configured to accept the insertion of an end of the carpenter's pencil or crayon there-though for further insertion into the conical void 35. The circular bore, preferably defining a diameter of about 18 millimeters and a length of about 2.6 millimeters, thus defines a shortened primary circumferal aligning surface 56 both adjacent to and coaxial with the primary 40 orifice for axially aligning a carpenter's crayon. The shortened primary circumferal aligning surface 56, preferably cylindrical in shape, is configured for operational engagement with the outer surface of the carpenter's crayon to prevent a torquing movement of the crayon when inserted into the conical void 35.

A circular collar 60, unitary with the body 10, is both adjacent to and coaxial with the primary circumferal aligning surface 56. In a preferred embodiment, the collar 60 comprises a plurality of inwardly deflectable semi-circular flanges 65 having inner and outer surfaces 66 and 67. The inner surfaces 66 of the plurality of flanges collectively define a secondary circumferal aligning surface 68 for further axially aligning the carpenter's crayon. The secondary circumferal aligning surface 68, having a length of about 4 millimeters, is also preferably cylindrical in shape to define a diameter of about 22 millimeters and again configured for operational engagement with the outer surface of the carpenter's crayon when inserted into the conical void 35, supplements (i.e., lengthens) the primary shortened primary alignment surface 56 to effectively axially stabilize the crayon. Because of the presence of the secondary aligning surface 68 incorporated into the flanges 65, with the flanges also functioning to removably attach the cap to the sharpener (to be further discussed), the utilization of a shortened primary aligning surface 56 is made possible, thus saving on material costs without jeopardizing the sharpener's ability to axially align crayons.

The outer surfaces 67 of the plurality of flanges respectively define a plurality of outwardly directed circumferal ridges 70. Each inwardly deflectable flange 65, having a respective outwardly directed circumferal ridge 70 defined thereon, thus flexes to pivot about a unitary connection with the body 10 to allow for an inward displacement of the ridge. As best illustrated in FIG. 3, an exterior cap 75 defines an outwardly directed circumferal groove 80 defined within circular interior wall 82, and a through secondary orifice 85. The secondary orifice 85 is coaxial with the circumferal groove 80 and is configured to accept the insertion of an end of the carpenter's pencil there-through. The secondary orifice 85 thus defines at least one flattened hexagonal slot 90 to accommodate the flattened hexagonal shape of the carpenter's pencil therein. A transverse hexagonal slot 95 is optionally defined coaxial with and across a center of the flattened hexagonal slot 90 to accommodate the insertion of smaller pencils therein.

The exterior cap 75 and body 10 are removably attachable to one another via a mating engagement between of the cap's outwardly directed circumferal groove 80 and the body's plurality of outwardly directed ridges 70. The deflectable flanges 65 allow for an inward displacement of the ridges such that the cap may snap onto and off of the body's collar 60 via a "snap-fit." The mating engagement between the groove 80 and ridges 70 define both a rotatable relation between the body 10 and cap 75 and a coaxial relation between the primary and secondary orifices 40 and 85. The "female" orientation of the cap's interior wall 82 about the "male" orientation of the body's collar 60 ensures that any sharpening debris, located on the flange inner surfaces 65, do not interferingly contact the fitment between the cap and body.

To aid in a placement of the cap 75 onto the body 10 or a removal of the cap there-from, the cap preferably defines an outwardly directed grip 100. In a preferred embodiment, the grip 100 preferably defines at least one circumferal rib 105 located on an outside circumferal surface 110 of the cap. Because the rib 105 defines a diameter slightly larger than that of the cap's outside surface 110, one may readily grasp the rib to aid in securely holding the cap 75 during placement and removal operations in relation to the body 10.

Referring again to FIGS. 1 and 2, a through transverse through orifice 115 is preferably defined in the body's second end 20. The transverse through orifice 115 is preferably oriented about transverse to the coaxial primary and secondary orifices 40 and 85. The transverse through orifice facilitates an optional connection of the sharpener 5 to a lanyard, keychain, belt clip or similar device for ease of transport and storage. In a preferred embodiment, the transverse through orifice 115 is about semi-circular in shape. However, it is understood that circular, ovular, square, rectangular, or any other shape may be utilized as well.

In operation for sharpening a carpenter's pencil (cap attached to body): 1) a carpenter's pencil is inserted through the secondary orifice of the cap, through the primary orifice of the body and into the body's conical void; and 2) the pencil and cap are rotated in relation to body such that the outside surface of the pencil is cut and shaped by the cutting edge of the blade, thus performing the sharpening operation.

In operation for sharpening a carpenter's crayon (cap removed from body): 1) the cap is removed from the body by gripping the body and the outer surface and grip of the cap and pulling them body and cap axially outwardly from one another. 2) the outwardly directed ridges of the collar displace inwardly to allow for their disengagement from the outwardly directed groove of the cap; 3) with the cap removed from the body, a carpenter's crayon is inserted through the primary orifice of the body and into the body's conical void; and 4) the crayon is e rotated in relation to body such that the outside surface of the crayon is cut and shaped by the cutting edge of the blade, thus performing the sharpening operation.

While this foregoing description and accompanying figures are illustrative of the present invention, other variations in structure and method are possible without departing from the invention's spirit and scope.

We claim:

1. An apparatus for sharpening marking implements comprising:

a body defining first and second ends;

an interior conical wall unitary with the body and defining a through longitudinal slot, the conical wall further defining a conical interior void coaxially terminating in a through primary orifice defined in the first end of the body;

a blade connected to the body proximal to the slot and defining a longitudinal cutting edge within the conical interior void;

a primary circumferal aligning surface both adjacent to and coaxial with the primary orifice for axially aligning a carpenter's crayon;

a collar unitary with the body both adjacent to and coaxial with the primary circumferal aligning surface, the collar comprising a plurality of inwardly deflectable flanges having inner and outer circumferal surfaces, the outer surfaces of the plurality of flanges respectively defining a plurality of outwardly directed circumferal ridges and the inner surfaces of the plurality of flanges defining a secondary circumferal aligning surface for further axially aligning the carpenter's crayon; and a cap defining an outwardly directed circumferal groove and a through secondary orifice, the secondary orifice configured for mating engagement with at least a carpenter's pencil and coaxial with the circumferal groove, the cap and body removably attachable to one another via a mating engagement between of the circumferal groove and the ridges, the mating engagement between the groove and ridges defining both a rotatable relation between the body and cap and a coaxial relation between the primary and secondary orifices, the through secondary orifice axially aligning at least the carpenter's pencil.

2. The apparatus of claim 1 wherein the secondary orifice defines at least a flattened hexagonal slot.

3. The apparatus of claim 2 further comprising a transverse hexagonal slot defined coaxial with and across a center of the flattened hexagonal slot.

4. The apparatus of claim 1 wherein the body defines a through transverse through orifice in the second end.

5. The apparatus of claim 1 wherein the cap defines an outwardly directed grip.

6. The apparatus of claim 5 wherein the grip comprises defines a circumferal rib located on an outside circumferal surface of the cap.

7. An apparatus for sharpening marking implements comprising:

a body defining first and second ends, the second end defining a transverse through orifice;

an interior conical wall unitary with the body and defining a through longitudinal slot, the conical wall further defining a conical interior void coaxially terminating in a through primary orifice defined in the first end of the body;

a blade connected to the body proximal to the slot and defining a longitudinal cutting edge within the conical interior void;

a primary circumferal aligning surface both adjacent to and coaxial with the primary orifice for axially aligning a carpenter's crayon;

a collar unitary with the body both adjacent to and coaxial with the primary circumferal aligning surface, the collar comprising a plurality of inwardly deflectable flanges having inner and outer circumferal surfaces, the outer surfaces of the plurality of flanges respectively defining a plurality of outwardly directed circumferal ridges and the inner surfaces of the plurality of flanges defining a secondary circumferal aligning surface for further axially aligning the carpenter's crayon; and a cap defining an outwardly directed circumferal groove and a through secondary orifice, the secondary orifice defining a flattened hexagonal and transverse hexagonal slot configured for mating engagement with at least a carpenter's pencil and coaxial with the circumferal groove, the cap and body removably attachable to one another via a mating engagement between of the circumferal groove and the ridges, the mating engagement between the groove and ridges defining both a rotatable relation between the body and cap and a coaxial relation between the primary and secondary orifices, the through secondary orifice axially aligning at least the carpenter's pencil, the cap defining a circumferal rib on an outside circumferal surface.

* * * * *